US006189337B1

(12) United States Patent
Mathews

(10) Patent No.: US 6,189,337 B1
(45) Date of Patent: Feb. 20, 2001

(54) AIR SEPARATION APPARATUS

(75) Inventor: Michael Sylvester Mathews, Taipei (TW)

(73) Assignee: The BOC Group plc, Windlesham (GB)

( * ) Notice: Under 35 U.S.C. 154(b), the term of this patent shall be extended for 0 days.

(21) Appl. No.: 09/171,109

(22) PCT Filed: Apr. 4, 1997

(86) PCT No.: PCT/GB97/01035

§ 371 Date: Mar. 5, 1999

§ 102(e) Date: Mar. 5, 1999

(87) PCT Pub. No.: WO97/39298

PCT Pub. Date: Oct. 23, 1997

(51) Int. Cl.[7] ..... F25J 1/00
(52) U.S. Cl. ..... 62/642; 62/644
(58) Field of Search ..... 62/640, 641, 642, 62/644

(56) References Cited

U.S. PATENT DOCUMENTS 2,932,174 * 4/1960 Schilling ..... 62/909
3,477,239 * 11/1969 Rische ..... 62/640
3,950,957 * 4/1976 Zakon ..... 62/644
4,459,143 * 7/1984 Nawata et al. ..... 62/641
5,425,240 * 6/1995 Jain et al. ..... 62/641

FOREIGN PATENT DOCUMENTS

542539 A1 5/1993 (EP) .
0653599 A1 5/1995 (EP) .

* cited by examiner

*Primary Examiner*—Ronald Capossela
(74) *Attorney, Agent, or Firm*—Salvatore P. Pace

(57) ABSTRACT

There is provided an air separation apparatus comprising, in fluid flow communication, a compressor having at least two stages in senes, a first outlet from a stage upstream of the final stage, an air purifier in fluid flow communication with the outlet and producing purified air in two parallel flow paths. One of the flow paths is in fluid flow communication, through a heat exchanger, to a rectification column that produces a purified nitrogen product. The second flow path in fluid flow communication with an inlet of the compressor downstream of the chosen stage and provides a purified air product via the compressor through a second outlet thereof also downstream of the chosen stage.

2 Claims, 1 Drawing Sheet

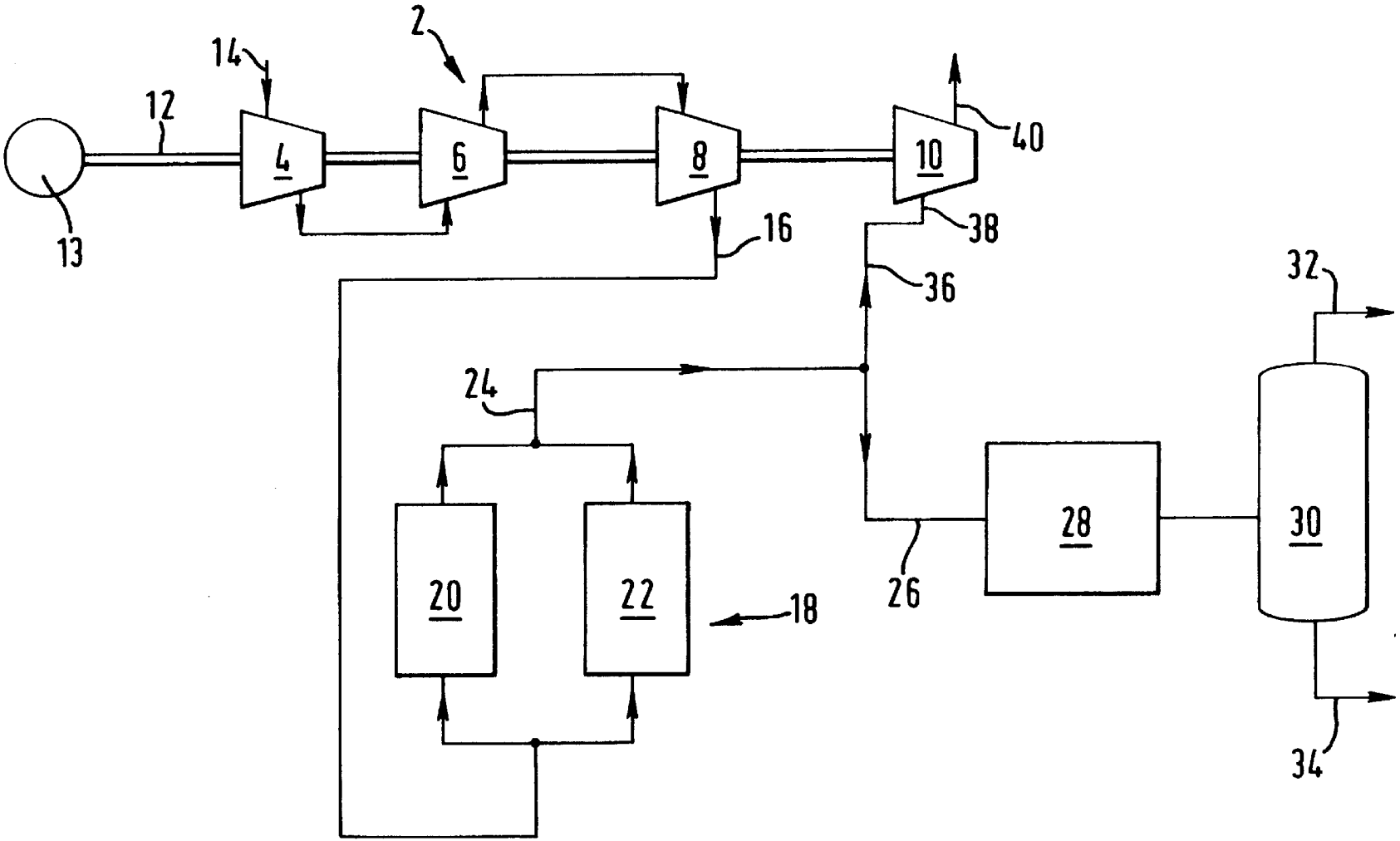
32
30
34
28
40
38
36
26
10
18
16
8
22
24
2
6
20
14
4
12
13

AIR SEPARATION APPARATUS

This invention relates to an air separation apparatus.

Air separation apparatus employing a purifier for removing impurities such as water vapour and carbon dioxide from incoming compressed air, a heat exchanger for cooling the purified, compressed air to a temperature suitable for its separation by rectification, and at least one rectification or fractionation column for separating one or both of nitrogen and oxygen products from the air is well known.

Such air separation apparatus is, for example, used to provide high purity nitrogen to the electronics industry. The air separation apparatus may for this purpose take the form of any of the embodiments disclosed in EP-A-0 412 793 or EP-A-0 520 738.

There is often a need to supply to the same manufacturer of electronics components separate pure air and pure nitrogen products. Separate apparatuses are used for this purpose.

It is an aim of the present invention to provide a single apparatus which is able both to supply a product of air separation and purified air.

According to the present invention there is provided an air separation apparatus comprising a compressor having at least two stages in series, a first outlet from a chosen stage upstream of a final stage of the compressor, a second outlet from the final stage of the compressor, an air purifier having an inlet communicating with the first outlet and an outlet communicating with first and second flow paths in parallel with one another, wherein the first flow path leads via a heat exchanger to at least one rectification column for separating the air, there being an outlet for a nitrogen product from the said rectification column, the second flow path leads via the stage or stages downstream of said chosen stage to the second outlet, and the second outlet provides an outlet from the apparatus for a purified air product.

The apparatus according to the invention is thus able to provide a pure air product from the second outlet and at least one product of air separation from the rectification column least two such adsorbers in parallel. In a particularly preferred arrangement the air purifier is effective to remove water vapour, carbon dioxide and one or both of hydrogen and carbon monoxide impurities from the air.

The apparatus according to the invention typically additionally includes at least one expansion turbine for generating refrigeration for the separation of the air.

By employing a single air purifier and a single train of compressor stages in order to produce a product of air separation (for example nitrogen) and purified air, the invention makes possible a simplification of the known apparatus which requires separate compressors for both nitrogen and air production and separate air purifiers.

An apparatus according to the present invention will now be described by way of example only with reference to the accompanying drawing which is a schematic flow diagram of an air separation apparatus.

The drawing is not to scale.

Referring to the drawing, an air compressor 2 comprises a train of four compression stages 4, 6, 8 and 10 having a common motor drive 13. Transmission from the motor 13 to the shafts 12 of the respective stages 4, 6, 8, 10 is typically via a common gear wheel (not shown). The most upstream stage 4 has an inlet 14 for air. Each of the stages 4, 6, 8 and 10 has an aftercooler (not shown) associated therewith so as to remove heat of compression. Operation of the air compressor 2 draws a flow of air into the inlet 14. The entire flow of air passes through each of the stages 4, 6 and 8 in sequence. The entire air flow, now at a pressure typically in the range of 5 to 6 bar absolute, flows out of the third stage 8 of the compressor 2 through an outlet 16 to an air purifier 18 typically comprising adsorbent beds 20 and 22. The general arrangement is that while one of the adsorbent beds 20 and 22 is in service, the other is being regenerated or lying idle. Thus, continuous purification is made possible. The beds 20 and 22 comprise one or more adsorbents able selectively to remove water vapour and carbon dioxide impurities from the air. For example, activated alumina may be used as a bottom layer to remove water vapour and a zeolite (eg zeolite 13X) to remove carbon dioxide. Alternatively, alumina may be used for both duties. In another alternative, there is a layer of an oxidation catalyst effective to convert carbon monoxide impurity to carbon dioxide. The catalyst layer may also include a further oxidation catalyst (e.g. palladium) effective to oxidise hydrogen impurity to water vapour. This layer is typically sandwiched between a lower layer of an adsorbent of water vapour and an upper layer of an adsorbent of carbon dioxide. Such arrangements are described in EP-A-0 438 282. The purifier 18 may operate by pressure swing adsorption. Regeneration of the beds 20 and 22 may include the step of purging them with a product of air separation. For example, if the air is separated so as to form a nitrogen product for supply to an electronics plant and an oxygen-enriched air product which is not otherwise required in the electronics plant, the oxygen-enriched air may be employed to regenerate the beds 20 and 22 since it is essentially free of water vapour and carbon dioxide impurities. The amount of such air that is available is generally well in excess of that needed for regeneration purposes. If desired, the air may be chilled by means of a refrigerator (not shown) intermediate the outlet 16 and the air purifier 18.

The purifier 18 has an outlet 24 which communicates with a first conduit or flow path 26 leading via a heat exchanger 28 to at least one rectification column 30 for separating air. The arrangement of the heat exchanger 28 and the rectification column 30 may be as described with reference to any of the drawings in EP-A-0 412 793 or EP-A-0 520 738. The rectification column 30 may for example, as shown, have an outlet 32 for a nitrogen product and an outlet 34 for the aforementioned oxygen-enriched air.

The outlet 24 from the air purifier 18 also communicates with a second conduit or flow path 36 which leads to an inlet 38 to the fourth or most downstream stage 10 of the compressor 2. The purified air is therefore further compressed and typically leaves the fourth stage 10 through an outlet 40 as a pure air product at a pressure typically in the range of 10 to 15 bar.

What is claimed is:

1. An air separation apparatus comprising:

a compressor having at least two stages in series, a first outlet from a chosen stage thereof upstream of a final stage thereof and an inlet at a stage downstream of said chosen stage, said first outlet being in fluid flow communication with an inlet to;

an air purifier, said air purifier having an outlet for providing purified air therefrom, said outlet in fluid flow communication with and forming a first and second flow path in parallel;

said first flow path being in fluid flow communication via a heat exchanger with;

at least one rectification column which has an outlet for providing purified nitrogen as a product; and said second flow path being in fluid flow communication with said inlet to said compressor and providing, via said compressor and through a second outlet therein, a purified air product, said second outlet being downstream of said chosen stage.

2. An air separation apparatus according to claim 1, in which the air purifier (18) is effective to remove water vapour, carbon dioxide, and one or both of hydrogen and carbon monoxide impurities from the air.

* * * * *